United States Patent [19]

Costar

[11] Patent Number: 5,014,383

[45] Date of Patent: May 14, 1991

[54] OFFSET DENTURE BRUSH

[76] Inventor: Donald G. Costar, P.O. Box 9905, Reno, Nev. 89507

[21] Appl. No.: 496,963

[22] Filed: Mar. 20, 1990

[51] Int. Cl.[5] ..... A46B 5/02

[52] U.S. Cl. ..... 15/160; 15/167.1; 15/187

[58] Field of Search ..... 15/160, 167.1, 187, 15/159 A; D32/52; D4/29, 30

[56] References Cited

U.S. PATENT DOCUMENTS

| | | | |
|---|---|---|---|
| 608,365 | 8/1898 | Goehring | 15/160 |
| 1,437,794 | 12/1922 | Cleveland | 15/160 |
| 1,813,076 | 7/1931 | Newell | 15/167 |
| 2,043,338 | 6/1936 | Sommerfeld | 15/160 |
| 2,190,277 | 2/1940 | Viragh | 15/167 |
| 2,629,890 | 3/1953 | Giovanna | D32/52 |
| 3,128,488 | 4/1964 | Schad | 15/187 |
| 3,214,777 | 11/1965 | Kutik | 15/159 A |
| 3,732,973 | 5/1973 | Crawford | 206/15.1 E |
| 3,864,781 | 2/1975 | Leonard | 15/106 |
| 4,010,509 | 3/1977 | Huish | 15/167 R |
| 4,480,351 | 11/1984 | Koffler | 15/187 |

*Primary Examiner*—Harvey C. Hornsby
*Assistant Examiner*—Patrick Brinson

[57] ABSTRACT

A brush apparatus consisting of a planar member with a plurality of bristles affixed to a body and handle unit whereby the handle is parallel to and axially offset from the centerline axis of the said planar member.

3 Claims, 1 Drawing Sheet

OFFSET DENTURE BRUSH

BACKGROUND

1. Field of Invention

Applicant's invention relates to denture brushes. Specifically, applicant's invention relates to denture brushes having a handle that is offset axially from, and parallel to, the plane of bristles.

2. Discussion of Prior Art

Heretofore, the problem of cleaning unwanted contaminants from dentures has resulted in the development of various toothbrush style devices or denture soaking solutions.

Toothbrush style devices usually incorporate one or more planar surfaces of bristle tufts having varying widths, varying lengths, some angled axially about the central axis, or combinations thereof. They heretofore have mostly had, for a handle, merely an elongated extension of the bristle plane. That style of handle requires a necessary, and minimal, degree of dexterity or strength by the user for manual operation.

Because complete and effective denture cleaning still requires scrubbing and brushing, denture wearers heretofore had to rely on brushes of the toothbrush-style configuration, or brushes suited more aptly to scrubbing fingernails. Therein lies the problem. Even though present denture brushes are effective in function, they require the user to possess sufficient strength and dexterity in his fingers and hands.

Denture wearers that have limited use of their hands and fingers because of injuries, an arthritic condition or some infirmity, have additional problems when using denture brushes shaped like toothbrushes. The size and shape of toothbrush style handles are generally too small and too narrow to grasp comfortably when one has diminished use of fingers or hands, plus the handles can become slippery when wet and covered with cleansing paste or liquid.

It would appear that denture brushes heretofore have been configured primarily to conform to marketing requirements dictated by the display racks used in retail stores.

The following references are cited to illustrate the points heretofore mentioned:

1. U.S. Pat. No. 1,813,076 to Newell (1931), reveals a novel bristle configuration at each end of a narrow elongated handle that typifies how inventors have concentrated on the function while not fully addressing the problems encountered by the users.
2. U.S. Pat. No. 2,190,277 to Viragh (1940), who paid considerable attention to bristle placement, making it better adapted to cleaning dentures, but again, only if users have adequate hand strength and finger dexterity.
3. U.S. Pat. No. 3,732,973 to Crawford (1973), reveals a configuration well suited to the problem of storage, for marketing appeal, but inadequate for use without above average hand strength to hold the small curved handle.
4. U.S. Pat. No. 3,864,781 to Leonard (1975), who recognized the inadequacies of the standard toothbrush for cleaning dentures, but still employed the long narrow handle that people find so difficult to use when wet and slippery.

5. U.S. Pat. No. 4,010,509 to Huish (1977), showing a typical toothbrush improvement, but with long narrow handle.
6. U.S. Pat. No. 4,480,351 to Koffler (1984) is not intended to be used for the cleaning and scrubbing of dentures, but illustrates a bristle configuration that meets the requirements for scrubbing and cleaning dentures better than the smaller and narrower configurations of a toothbrush style denture brush.

All the above references cited and others, generally known to the inventor, appear to have adequate capabilities for the scrubbing and cleaning of dentures, and while the intended purpose of the present devices is not disputed, all toothbrush style implements, revealed through a preliminary search by the inventor, seem to have the common shortcoming of focusing on the scrubbing and cleaning function, while not fully addressing the problems encountered by many denture wearers, to wit: lack of adequate strength and dexterity in their hands and fingers to use the devices as intended. The applicant's invention addresses that problem and fills that need.

SUMMARY OF INVENTION—OBJECTS AND ADVANTAGES

Accordingly, several of the objects and advantages of the invention are:

as a first object:

(a) to provide an improved brush for the scrubbing and cleaning of dentures and having a handle configuration that allows comfortable grasping by the user.

as a second object:

(b) to provide a brush having a handle configuration axially off-set from a center line perpendicular to the plane of bristles so the user can scrub the inside surface of the "U" shaped lower denture without unintenionally striking the opposite portion of the denture.

as a third object:

(c) to provide a brush having a handle off-set from the center line perpendicular to the plane of bristles, that may be operated by right or left handed users.

as a fourth object:

(d) to provide a brush configuration that may be comfortably grasped for manual operation by users who have less than full capacity of their hands or fingers.

as a fifth object:

(e) to provide a denture brush that addresses the needs and requirements of the user, as a priority over configurations dictated by marketing convenience, such as store display racks.

Further objects and advantages will become apparent from a consideration of the ensuing description and drawings.

REFERENCE NUMERALS IN DRAWINGS

21 offset handle and body of brush.
22 bristles.
23 lower denture.
24 centerline of plane of bristles.
25 axial offset handle position.
31 offset handle and body of brush.
32 bristles.
33 centerline of plane of bristles.
34 axial offset handle position.

DESCRIPTION OF INVENTION

Figure 1:
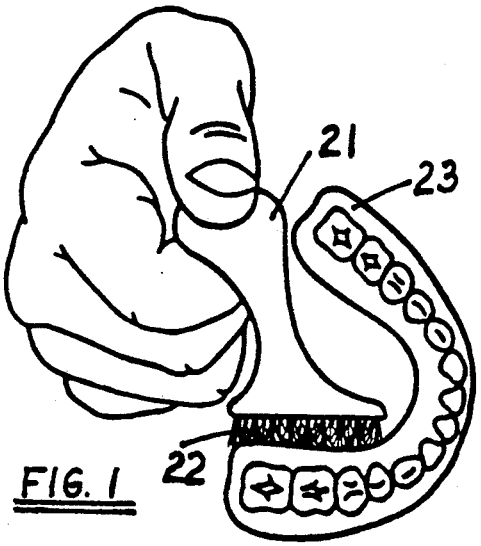
FIG. 1 is an end elevation view of the offset denture brush, in use.
Figure 2:
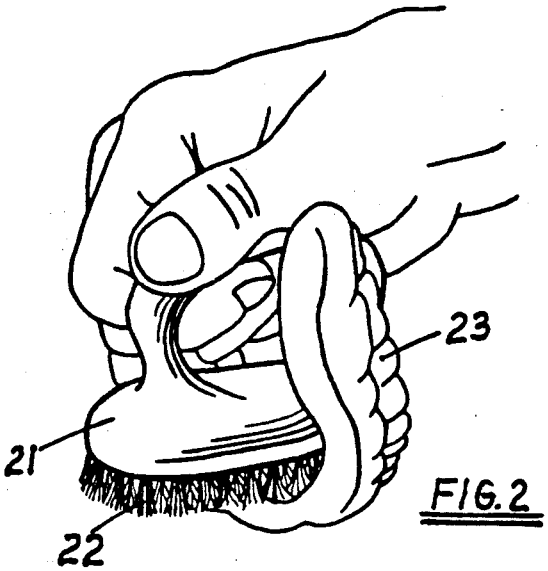
FIG. 2 is a perspective view of the offset denture brush in use.

FIG. 1 shows an end elevation view of a preferred embodiment of the invention, in use. The handle and body 21 of the present invention is typically of one integrated part, and serves as both a grasping handle 21 and a receptacle body 21 for the bristles 22.

The basic configuration of the offset denture brush, (FIGS. 1–5), is one that embodies the grasping handle 21 offset 25 from the centerline axis of the plane of bristles 24, but parallel to the same centerline axis of the plane of bristles 24.

An alternate embodiment of the offset denture brush, (FIGS. 6–8), is one that while utilizing the handle and body part 31 resembling a "TEE" configuration, still embodies the basic concept of a handle 31 offset 34 from the centerline axis of the plane of bristles 33.

The grasping handle and body part 21 of the offset denture brush, (FIGS. 1–5,) and 31 (FIGS. 6–8), may be constructed of any suitable material, but preferably of a rigid, durable plastic material which is either opaque, translucent or transparent, and of any suitable color. The bristles 22, (FIGS. 1–5) and 32 (FIGS. 6–8) may be of any material that is typically used in the manufacture of denture brush bristles. They may be constructed of any suitable length, but preferably between 1 cm. and 2 cm. usable length.

The grasping handle and body part 21, (FIGS. 1–5) and 31 (FIGS. 6–8) may be of any suitable size to fit the use for which it is constructed, but for denture 23 (FIGS. 1 & 2) scrubbing and brushing, it should preferably be between 10 cm. and 12 cm. in length 2 cm. to 4 cm. in width and 4 cm. to 5 cm. in height.

Figure 4:
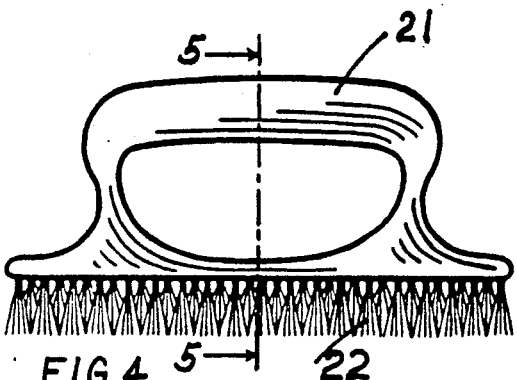
FIG. 4 is a side elevation view of the brush in FIG. 1.
Figure 5:
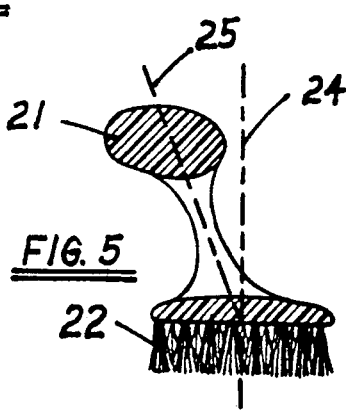
FIG. 5 is a cross-sectional view taken along lines 5—5 of the brush in FIG. 4.

Using FIG. 5 as an example (cross-sectional view of the offset denture brush in FIG. 4), the angle that the grasping handle 21 (FIGS. 1–5) or 31 (FIGS. 6–8), is offset 25 (FIG. 5) or 34 (FIG. 8), from the centerline of the plane of bristles 24 (FIG. 5) or 33 (FIG. 8), may be any angle that is sufficient to allow comfortable manual operation, but preferably 15° to 30° from vertical.

Any conventional method of affixing suitable bristles 22 (FIGS. 1–5) or 32 (FIGS. 6–8), to the offset handle and body 21 (FIGS. 1–5) or 31 (FIGS. 6–8), is suitable, insofar as the affixed bristles would be at least as securely embedded as conventional toothbrush and denture brush bristles.

The brush having first and second faces that are parallel to and opposite each other. The handle being affixed to the second face, having one end attached to the second face and a spaced second end, FIGS. 3 an 4, such that the user hand is inserted between the spaced second end and the brush second face when in use, FIGS. 1 and 2. The handle attachment being along the vertical centerline of the brush faces, and the second end of the point where the second end projects beyond the edge of the planar faces, FIGS. 5 and 8, such that when the bristles are in cleaning contact with the denture surfaces, the user hand is offset from the denture which allows the user to safely and effectively clean the dentures.

OPERATION

The operation of the described embodiments of the invention is believed to be readily apparent from the drawings and the summary as heretofore written.

Further operational specifics can become apparent when one considers the possible loss of strength, tactile sense or dexterity of users, due to injuries or infirmities affecting the hands or fingers: the handle portion of the invention is sized and placed advantageously so as to be comfortably grasped by the users, even though they may have diminished strength and dexterity in their hands or fingers.

In addition to the larger size and strategic placement of the handle of the invention, it is also offset from a center line axis of the bristle plane so that while brushing the inside surface of the lower denture, as illustrated in FIG. 1, the user does not inadvertantly strike the opposite side of the denture.

Figure 6:
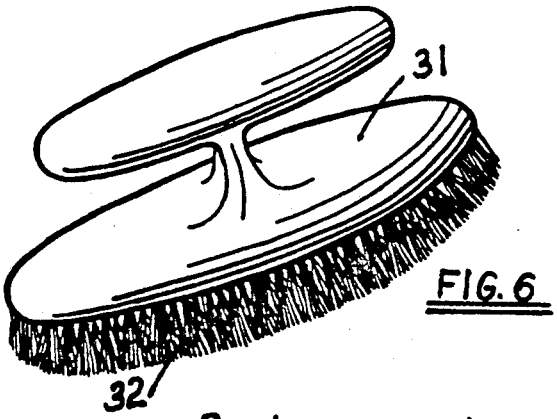
FIG. 6 is a perspective view of an alternate embodiment of the brush shown in FIG. 3.
Figure 7:
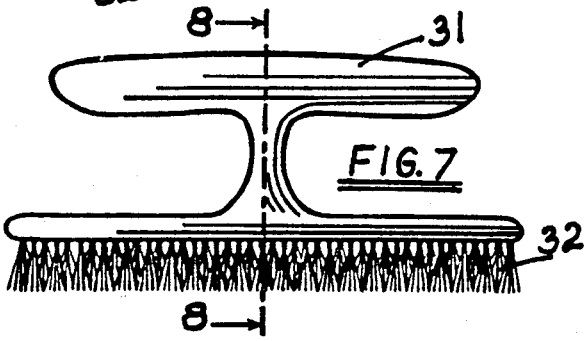
FIG. 7 is a side elevation view of the brush in FIG. 6.
Figure 8:
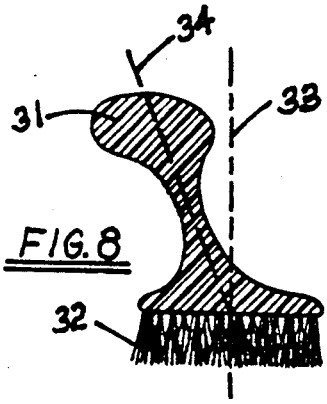
FIG. 8 is a cross-sectional view taken along lines 8—8 of the brush shown in FIG. 7.

Because the fingers of some users might be misshapen, missing, stiff or larger than usual, alternative embodiments of the offset denture brush may become apparent, as shown in FIGS. 6 & 7, for example.

Figure 3:
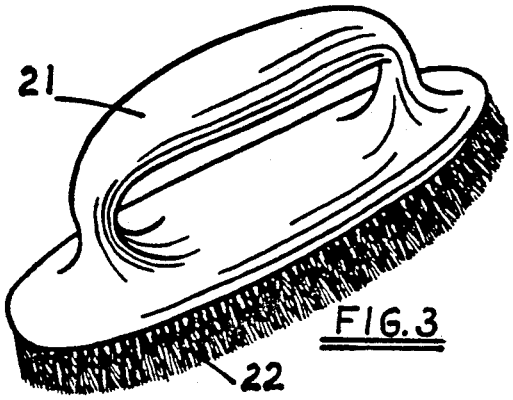
FIG. 3 is a perspective view of the brush in FIG. 1.

Handles similar to those shown in FIGS. 3 & 4, but attached only at one end, are also suitable, however to be used by either right or left handed users, the preferred embodiments are reversible, as shown in the accompanying drawings.

It should also be noted that, as illustrated in FIGS. 3,4,6 & 7, the plane of bristles extend axially beyond the handle portions of the invention. This additional extension of the bristle plane provides for scrubbing dentures beyond the position of the user's hand when encountering a limited space between the back surface of a typical bathroom sink and the flow of water from a typical bathroom faucet fixture.

Although the descriptions above contain specifics, they should not be construed as limiting the scope of the invention, but as merely providing illustrations of some preferred embodiments.

Thus, the scope of applicant's invention should be determined by the appended claims and their legal equivalents, rather than only by the examples given.

What is claimed and desired to be secured by Letters Patent of the United States is:

1. A denture scrubbing brush comprising a planar oval shaped member having first and second faces that are parallel to and opposite each other, a plurality of bristles affixed to and extending from said first face, a grasping handle affixed to said second face, said handle having one end attached to the second face and a spaced second end for grasping by the user, such that the user hand is inserted between the spaced second end and the brush second face when in use, the handle attachment to the brush being along the vertical centerline of the brush faces, and the spaced second end of the handle being offset to one side from the vertical centerline to a point where the second end projects beyond the edge of the planar faces, whereby said angle of attachment causes said grasping handle to become strategically placed parallel to, but offset from, a longitudinal plane perpendicular to said first face, such that when the brush bristles are in cleaning contact with denture surfaces, the user hand is offset from the denture which allows a user to safely and effectively clean said dentures by exercising a scrubbing motion on said denture surfaces.

2. The denture scrubbing brush of claim 1 where said grasping handle is configured for use by either the right or left hand, and fingers, of said user.

3. The denture scrubbing brush of claim 1, where said grasping handle is configured to terminate in a "T" shape.

* * * * *